US007968063B2

(12) United States Patent
Shibuya et al.

(10) Patent No.: US 7,968,063 B2
(45) Date of Patent: Jun. 28, 2011

(54) MERCURY REMOVAL APPARATUS FOR LIQUID HYDROCARBON

(75) Inventors: Hiromitsu Shibuya, Higashi Ibaraki-gun (JP); Kazuo Sato, Higashi Ibaraki-gun (JP); Yoshiyuki Yamaguchi, Tokyo (JP); Senichiro Kaku, Tokyo (JP)

(73) Assignees: JGC Corporation, Tokyo (JP); Japan Petroleum Exploration Co., Ltd., Tokyo (JP)

( * ) Notice: Subject to any disclaimer, the term of this patent is extended or adjusted under 35 U.S.C. 154(b) by 997 days.

(21) Appl. No.: 11/722,401

(22) PCT Filed: Feb. 10, 2006

(86) PCT No.: PCT/JP2006/302367

§ 371 (c)(1),
(2), (4) Date: Jun. 21, 2007

(87) PCT Pub. No.: WO2006/090597

PCT Pub. Date: Aug. 31, 2006

(65) Prior Publication Data

US 2010/0025184 A1 Feb. 4, 2010

(30) Foreign Application Priority Data

Feb. 24, 2005 (JP) ..... 2005-048581

(51) Int. Cl.
*C10G 29/04* (2006.01)
*B01J 8/00* (2006.01)

(52) U.S. Cl. ..... 422/609; 422/211; 422/212; 422/213; 422/215; 196/155; 96/243; 96/290

(58) Field of Classification Search ..... 422/211, 422/212, 213, 215, 609; 208/251 R; 585/835; 423/210; 210/263; 196/155; 96/243, 290
See application file for complete search history.

(56) References Cited

U.S. PATENT DOCUMENTS 4,170,552 A 10/1979 Generini
4,909,926 A 3/1990 Yan
4,946,582 A * 8/1990 Torihata et al. ..... 208/251 R
4,962,276 A * 10/1990 Yan ..... 585/867
4,985,137 A * 1/1991 Audeh ..... 208/251 H (Continued)

FOREIGN PATENT DOCUMENTS

EP 0659869 A1 6/1995

(Continued)

OTHER PUBLICATIONS

European Search Report mailed Nov. 29, 2010 for the corresponding European application No. 06713510.3.

*Primary Examiner* — N. Bhat
(74) *Attorney, Agent, or Firm* — Leason Ellis LLP.

(57) ABSTRACT

A mercury removal apparatus for a liquid hydrocarbon includes a conversion device which converts a mercury component in a raw liquid hydrocarbon into elemental mercury to obtain a first liquid hydrocarbon containing the elemental mercury. The apparatus also includes a first stripping device which brings the first liquid hydrocarbon into counter-current contact with a first stripping gas, thereby transferring the elemental mercury in the first liquid hydrocarbon to the first stripping gas to obtain (i) a second liquid hydrocarbon in which the amount of the elemental mercury decreases and (ii) a first gaseous hydrocarbon containing the elemental mercury.

15 Claims, 5 Drawing Sheets

U.S. PATENT DOCUMENTS

| | | | | |
|---|---|---|---|---|
| 5,384,040 | A | 1/1995 | Mank et al. | |
| 5,401,393 | A * | 3/1995 | Whitehurst et al. | 208/251 R |
| 5,510,565 | A | 4/1996 | Tan et al. | |
| 6,268,543 | B1 * | 7/2001 | Sakai et al. | 585/836 |
| 6,350,372 | B1 * | 2/2002 | Degnan et al. | 208/251 R |
| 6,537,443 | B1 * | 3/2003 | Frankiewicz et al. | 208/251 R |
| 6,793,805 | B2 * | 9/2004 | Didillon et al. | 208/251 H |
| 2002/0139721 | A1 | 10/2002 | Didillon et al. | |
| 2005/0167335 | A1 | 8/2005 | Yamaguchi et al. | |
| 2005/0204867 | A1 * | 9/2005 | Wang | 75/670 |
| 2006/0205592 | A1 * | 9/2006 | Chao et al. | 502/417 |

FOREIGN PATENT DOCUMENTS

| | | | |
|---|---|---|---|
| JP | 02-261895 | A | 10/1990 |
| JP | 2-261895 | A | 10/1990 |
| JP | 3-26790 | A | 2/1991 |
| JP | 03-026790 | A | 2/1991 |
| JP | 06-049458 | A | 2/1994 |
| JP | 6-49458 | A | 2/1994 |
| JP | 06-091129 | A | 4/1994 |
| JP | 6-91129 | A | 4/1994 |
| JP | 2630732 | B2 | 4/1997 |
| RU | 2147924 | C1 | 4/2000 |
| SU | 738507 | A3 | 5/1980 |

* cited by examiner

MERCURY REMOVAL APPARATUS FOR LIQUID HYDROCARBON

This application is a U.S. National Phase Application under 35 U.S.C. §371 of International Patent Application No. PCT/JP2006/302367, filed Feb. 10, 2006, and claims the benefit of Japanese Patent Application No. 2005-048581, filed Feb. 24, 2005, all of which are incorporated by reference herein. The International Application was published in Japanese on Aug. 31, 2006 as International Publication No. WO/2006/090597 under PCT Article 21(2).

FIELD OF THE INVENTION

The present invention relates to a mercury removal apparatus for a liquid hydrocarbon which removes the mercury component contained in a ground-derived liquid hydrocarbon, such as a crude oil or a natural gas condensate.

BACKGROUND ART

A crude oil or a natural gas condensate contains a mercury component in the broad range of 2 to 5,000 wtppb in forms of elemental mercury, ionic mercury, or organic mercury.

In a liquid hydrocarbon such as a crude oil, mercury exists in forms of "elemental mercury", "ionic mercury", or "organic mercury"; herein, mercury in these three forms is generally defined as a "mercury component", and "ionic mercury" and "organic mercury" are defined as a "mercury compound".

A mercury component contained in crude oil has various adverse effects of eroding aluminum devices, poisoning catalysts, or deteriorating ambient environment, so it is occasionally necessary to remove this mercury component as much as possible.

As a removal method for the mercury component contained in crude oil, there is the method disclosed in patent document 1 (Japanese Patent No. 2630732).

This removal method in patent document 1 brings a raw liquid hydrocarbon into contact with a catalyst, thereby converting the mercury component contained therein into elemental mercury, and thereafter distilling the liquid hydrocarbon so as to be separated into two fractions or more. The fraction whose elemental mercury content is low is used as a product, while the fraction whose elemental mercury content is high is processed by adsorption, thereby removing the elemental mercury.

However, in patent document 1, there is the problem in that the expenses are increased because of the cost of the devices such as a distillation column which distills liquid hydrocarbon. Also, there is the problem in that an adsorption process occasionally becomes difficult because there is a high risk that the fraction becomes contaminated with components which greatly inhibit adsorption in the case that fractions obtained by distillation is processed by adsorption.

Patent document 1: Japanese Patent No. 2630732

DISCLOSURE OF INVENTION

Therefore, one of the objectives of the present invention is to provide a mercury removal apparatus for a liquid hydrocarbon in which the devices which remove the mercury component contained in a liquid hydrocarbon such as a crude oil or a natural gas condensate can be provided inexpensively.

In order to solve these problems, a first aspect of the present invention is a mercury removal apparatus for a liquid hydrocarbon, including a conversion device which converts a mercury component in a raw liquid hydrocarbon into elemental mercury to obtain a first liquid hydrocarbon containing the elemental mercury; and a first stripping device which brings the first liquid hydrocarbon into counter-current contact with a first stripping gas, thereby transferring the elemental mercury in the first liquid hydrocarbon to the first stripping gas to obtain a second liquid hydrocarbon in which the amount of the elemental mercury decreases and a first gaseous hydrocarbon containing the elemental mercury.

A second aspect of the present invention is a mercury removal apparatus for a liquid hydrocarbon according to the first aspect of the present invention, further including a first adsorption device which adsorptively removes the elemental mercury from the first gaseous hydrocarbon to obtain a second gaseous hydrocarbon.

A third aspect of the present invention is a mercury removal apparatus for a liquid hydrocarbon according to the second aspect of the present invention, wherein the second gaseous hydrocarbon is used as the first stripping gas.

A fourth aspect of the present invention is a mercury removal apparatus for a liquid hydrocarbon according to the first aspect of the present invention, further including a first gas-liquid separation device which cools the first gaseous hydrocarbon so as to be separated into a third gaseous hydrocarbon and a third liquid hydrocarbon; and a second adsorption device which adsorptively removes the elemental mercury from the third gaseous hydrocarbon to obtain a fourth gaseous hydrocarbon.

A fifth aspect of the present invention is a mercury removal apparatus for a liquid hydrocarbon according to the fourth aspect of the present invention, wherein the fourth gaseous hydrocarbon is used as the first stripping gas.

A sixth aspect of the present invention is a mercury removal apparatus for a liquid hydrocarbon according to the fourth aspect of the present invention, further including a third adsorption device which adsorptively removes the elemental mercury from the third liquid hydrocarbon to obtain a fourth liquid hydrocarbon.

A seventh aspect of the present invention is a mercury removal apparatus for a liquid hydrocarbon according to the fourth aspect of the present invention, wherein the third liquid hydrocarbon is introduced into the first stripping device with the first liquid hydrocarbon.

An eighth aspect of the present invention is a mercury removal apparatus for a liquid hydrocarbon according to the first aspect of the present invention, further including a preliminary separation device provided before the conversion device, which separates the raw liquid hydrocarbon into a fifth gaseous hydrocarbon whose mercury component is in high concentration and a fifth liquid hydrocarbon whose mercury component is in low concentration, wherein the fifth liquid hydrocarbon is introduced into the conversion device.

A ninth aspect of the present invention is a mercury removal apparatus for a liquid hydrocarbon according to the eighth aspect of the present invention, wherein the preliminary separation device is a second stripping device which brings the raw liquid hydrocarbon into counter-current contact with a second stripping gas so as to be separated into the fifth gaseous hydrocarbon and the fifth liquid hydrocarbon.

A tenth aspect of the present invention is a mercury removal apparatus for a liquid hydrocarbon according to the eighth aspect of the present invention, further comprising a fourth adsorption device which adsorptively removes the mercury component from the fifth gaseous hydrocarbon to obtain a sixth gaseous hydrocarbon.

An eleventh aspect of the present invention is a mercury removal apparatus for a liquid hydrocarbon according to the tenth aspect of the present invention, wherein the sixth gaseous hydrocarbon is used as the first stripping gas.

A twelfth aspect of the present invention is a mercury removal apparatus for a liquid hydrocarbon according to the eighth aspect of the present invention, further including a second gas-liquid separation device which cools the fifth gaseous hydrocarbon to separate a seventh gaseous hydrocarbon and a sixth liquid hydrocarbon; and a fifth adsorption device which adsorptively removes the mercury component from the seventh gaseous hydrocarbon to obtain an eighth gaseous hydrocarbon.

A thirteenth aspect of the present invention is a mercury removal apparatus for a liquid hydrocarbon according to the twelfth aspect of the present invention, wherein the eighth gaseous hydrocarbon is used as the first stripping gas.

A fourteenth aspect of the present invention is a mercury removal apparatus for a liquid hydrocarbon according to the twelfth aspect of the present invention, further including a sixth adsorption device which adsorptively removes the mercury component from the sixth liquid hydrocarbon to obtain a seventh liquid hydrocarbon.

A fifteenth aspect of the present invention is a mercury removal apparatus for a liquid hydrocarbon according to the ninth aspect of the present invention, wherein the first gaseous hydrocarbon is used as the second stripping gas.

According to the first aspect of the present invention, a mercury compound in a mercury component in a raw liquid hydrocarbon is converted into elemental mercury, and a large portion of a mercury component is converted into elemental mercury, so the first liquid hydrocarbon can be obtained. This first hydrocarbon is brought into counter-current contact with the first stripping gas, whereby the elemental mercury in the first liquid mercury hydrocarbon is transferred to the first stripping gas, and the elemental mercury in the second liquid hydrocarbon drastically decreases. Also, the elemental mercury is transferred by stripping, so the operation is easy, and the device expenses can be lowered for the stripping device.

According to the second and third aspects of the present invention, the elemental mercury in the first gaseous hydrocarbon is removed by the first adsorption device, so the second gaseous hydrocarbon, in which the amount of the elemental mercury is low, can be obtained and used as the first stripping gas. Therefore, the external feed of a fresh stripping gas becomes unnecessary, and the device for the external feed also becomes unnecessary.

According to the fourth and fifth aspects of the present invention, the third liquid hydrocarbon which is obtained by the first gas-liquid separation device has a low content of elemental mercury. Also, the fourth gaseous hydrocarbon which is obtained by a second adsorption device hardly contains elemental mercury and is used as the first stripping gas. Therefore, the external feed of a fresh stripping gas becomes unnecessary.

According to the sixth aspect of the present invention, the fourth liquid hydrocarbon in which the amount of the elemental mercury is further lowered by the third adsorption device can be additionally obtained and used as a product.

According to the seventh aspect of the present invention, the amount of the elemental mercury in the third liquid hydrocarbon is slightly high, so the third liquid hydrocarbon can be used effectively by directly recycling it to the feed-side of the first stripping device with the first liquid hydrocarbon. In addition, the third adsorption device becomes unnecessary.

According to the eighth and ninth aspects of the present invention, the preliminary separation device is provided in the mercury removal apparatus for a liquid hydrocarbon of the present invention, whereby the raw liquid hydrocarbon containing a large amount of a mercury component, particularly elemental mercury, can be treated. When the second stripping device is used as the preliminary separation device, the device expenses can be reduced.

According to the tenth and eleventh aspects of the present invention, the elemental mercury in the fifth gaseous hydrocarbon is removed by the fourth adsorption device, so the sixth gaseous hydrocarbon in which the amount of the elemental mercury decreases can be obtained and effectively used as the first stripping gas.

According to the twelfth and thirteenth aspects of the present invention, the amount of the elemental mercury in the sixth liquid hydrocarbon obtained by the second gas-liquid separation device decreases, so the sixth liquid hydrocarbon can be used as a product. Also, the feed rate of a hydrocarbon to the fifth adsorption device decreases, so the load is reduced. In addition, the amount of the elemental mercury in the eighth gaseous hydrocarbon is low, so the eighth gaseous hydrocarbon can be used as the first stripping gas, and the external feed of a fresh stripping gas becomes unnecessary.

According to the fourteenth aspect of the present invention, the seventh liquid hydrocarbon in which the amount of the elemental mercury is further lowered by the sixth adsorption device can be obtained and used as a product.

According to the fifteenth aspect of the present invention, the first gaseous hydrocarbon can be used effectively by recycling it as the second stripping gas, and the reprocessing of the first gaseous hydrocarbon becomes unnecessary.

BEST MODE FOR CARRYING OUT THE INVENTION

Hereinafter, the present invention is described in detail.

The First Example of the Mercury Removal Apparatus of the Present Invention

Figure 1:
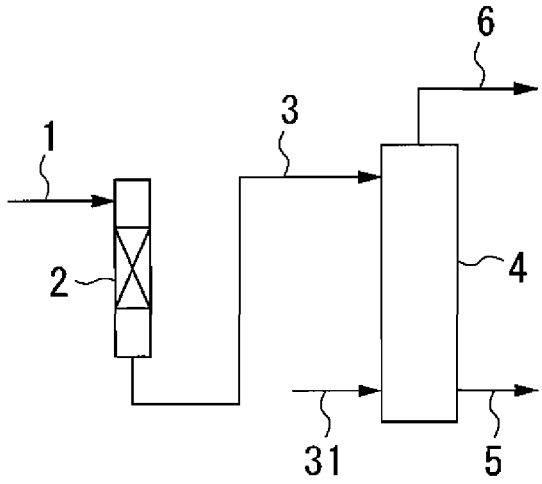
FIG. 1 is a schematic block diagram representing a first example of the mercury removal apparatus of the present invention.

FIG. 1 represents the first example of the mercury removal apparatus of the present invention and corresponds to the first aspect of the present invention.

A raw liquid hydrocarbon such as a crude oil or a natural gas condensate is introduced into the conversion device 2 through a pipe 1.

This conversion device 2 can be any device as long as it has the capability of converting a mercury compound into elemental mercury, while a catalyst column which is filled with a solid catalyst in which the metal such as iron, nickel, cobalt, molybdenum, tungsten, or palladium is supported by the carrier such as alumina, silica, zeolite, or activated carbon can be used specifically.

The form of the solid catalyst can be a fluid bed or a fixed bed. Also, as the solid catalyst, the activated carbon catalyst developed by JGC Corporation (product name: MR-14) is specifically preferable. This catalyst has the advantage in that a mercury compound can be converted into elemental mercury without using hydrogen.

The reaction conditions in the conversion device 2 are as follows: a temperature of 140 to 250° C., a pressure of 0.2 to 2.0 MPa·G, and a retention time of 5 to 80 min. Herein, "Pa·G" represents a gauge pressure.

By the reaction in the conversion device 2, a large portion of the mercury compound in the raw liquid mercury hydrocarbon is converted into elemental mercury, and a large portion of the mercury component in the first liquid hydrocarbon removed from the conversion device 2 becomes elemental mercury.

The first liquid hydrocarbon withdrawn from the conversion device 2 is introduced into a first stripping device 4 through a pipe 3. This first stripping device 4 brings the first liquid hydrocarbon into counter-current contact with the first stripping gas introduced through a pipe 31, thereby transferring the elemental mercury in the first liquid hydrocarbon to a first stripping gas.

As the specific first stripping device 4, the following is used: a packed column, a plate column, or a bubble column, each being filled with a filler such as a Raschig ring, a Pall ring, an Intalox (registered trademark) saddle, a Berl saddle, and a Goodloe (registered trademark) packing. Also, the following is used: a device which distributes the first liquid hydrocarbon from the liquid injection point near the top of the column and introduces the first stripping gas from the gas injection point near the bottom of the column, and then brings both into gas-liquid contact on the surface of a filler, thereby transferring the elemental mercury in the first liquid hydrocarbon to the first stripping gas, and then withdraws the first gaseous hydrocarbon containing elemental mercury from the top of the column and withdraws the second liquid hydrocarbon hardly containing elemental mercury from the bottom of the column.

As the first stripping gas, a gas such as nitrogen, methane, or town gas is used. These gases can include a slight amount of mercury. Herein, town gas refers to the gas in the gas group recited in the ministerial order concerning the official assay for gas products under the Gas Utility Industry Law in Japan, which is specifically a mixed gas containing natural gas, LP gas (liquefied petroleum gas), or gas made from coal or oil.

As the first stripping device 4, any of a packed column, a tray-type column, and a bubble column can be used, while a packed column is preferable. Also, a heating device can be installed at the bottom of the first stripping device 4 so as to control the temperature thereof. Hereinafter, the first stripping device 4 is described in the example using a packed column.

In the packed column, the temperature is 40 to 160° C., preferably 80 to 120° C., and the pressure is 0.005 to 1.000 MPa·G, preferably 0.01 to 0.05 MPa·G. The feed rate of the first liquid hydrocarbon to the packed column is 2,000 to 150,000 kg/m$^2$·hr, preferably 5,000 to 100,000 kg/m$^2$·hr, and the feed rate of the first stripping gas to the packed column is 500 to 10,000 kg/m$^2$·hr, preferably 800 to 5,000 kg/m$^2$·hr. Also, the gas/liquid flow ratio, that is the flow ratio of the stripping gas to liquid hydrocarbon, is 0.05 to 2.00 kg-G/kg-L, preferably 0.07 to 0.50 kg-G/kg-L. Herein, "hr", "G", and "L" represent hours, gas, and liquid, respectively.

The second liquid hydrocarbon withdrawn from the first stripping device 4 is withdrawn through a pipe 5 as a product hardly containing a mercury component, while the first gaseous hydrocarbon withdrawn from the first stripping device 4 is withdrawn through a pipe 6 and is reprocessed separately.

The Second Example of the Mercury Removal Apparatus of the Present Invention

Figure 2:
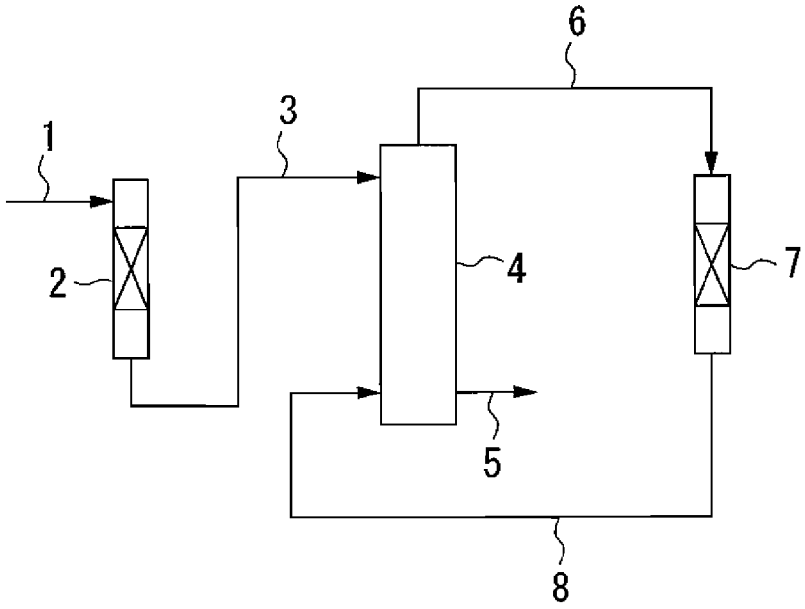
FIG. 2 is a schematic block diagram representing a second example of the mercury removal apparatus of the present invention.

FIG. 2 represents the second example of the mercury removal apparatus of the present invention and corresponds to the second and third aspects of the present invention.

The apparatus of this example further includes a first adsorption device 7 after the first stripping device 4 in addition to the apparatus represented by FIG. 1. The first gaseous hydrocarbon is introduced through the pipe 6 into the first adsorption device 7, in which the elemental mercury contained in the first gaseous hydrocarbon is adsorptively removed, and then the second gaseous hydrocarbon in which the amount of the elemental mercury is low is withdrawn to a pipe 8. Moreover, the second gaseous hydrocarbon is fed to the first stripping device 4 as the first stripping gas.

As the adsorption device 7, a so-called adsorption column is used, and as an adsorbent with which an adsorption column is filled, anything can be used without restricting the type of adsorbent as long as it can adsorb mercury in a gaseous form. Specifically, a adsorbent in which copper sulfide is supported by the carrier such as alumina, silica, or zeolite, can be used, while an adsorbent in which the sulfides of molybdenum are supported by a carrier formed of alumina with a high specific surface area (for example, the adsorbent developed by JGC Corporation (product name: MR-14)) is particularly preferable because it is excellent in adsorption rate and adsorption capacity. The adsorption conditions vary according to the type of adsorbent, while the linear velocity of a gas fluid to be processed in relation to an adsorbent is 0.1 to 2.0 m/sec, preferably 0.2 to 0.6 m/sec; the temperature is 0 to 120° C., preferably 0 to 80° C.; and the pressure is 0.005 to 0.200 MPa·G, preferably 0.01 to 0.10 MPa·G.

By the first adsorption device 7, a large portion of the elemental mercury contained in the first gaseous hydrocarbon is removed, so a second gaseous hydrocarbon hardly containing elemental mercury can be obtained. Therefore, it becomes possible for this second gaseous hydrocarbon to be introduced into the first stripping device 4 through the pipe 8 and recycled as the first stripping gas.

Accordingly, when the second gaseous hydrocarbon is recycled as the first stripping gas, it is occasionally necessary to deplete (purge) a part of the first stripping gas outside the system through the pipe 8 and to inject (make-up) the fresh stripping gas from the outside of the system through the pipe 8 in order to balance the feed rate of the first stripping gas and the feed rate of the first liquid hydrocarbon and to prevent the first stripping gas from increasing in weight due to the recycling.

The amounts of purge gas and make-up gas are decided in accordance with the feed rate of the raw liquid hydrocarbon, the characteristics thereof, the amount of the mercury component thereof, or the operation condition of the first stripping device 4, while the amounts are approximately 0.1 to 20.0 wt %, preferably 0.5 to 5.0 wt % of the second gaseous hydrocarbon.

In the recycling device which recycles the gaseous hydrocarbon generated in the system as the first stripping gas, for example, the below-mentioned apparatus of the third and fourth examples, the amounts of purge gas and make-up gas can be the same as described above.

Herein, it is unnecessary to recycle all of the second gaseous hydrocarbon from the first adsorption device 7 as the first stripping gas, and a part of or all of the second gaseous hydrocarbon can be depleted outside the system. Hereinafter, when the recycled gaseous hydrocarbon is used as the stripping gas in the present invention, a part of or all of the recycled gaseous hydrocarbon can be used as described above.

The Third Example of the Mercury Removal Apparatus of the Present Invention

Figure 3:
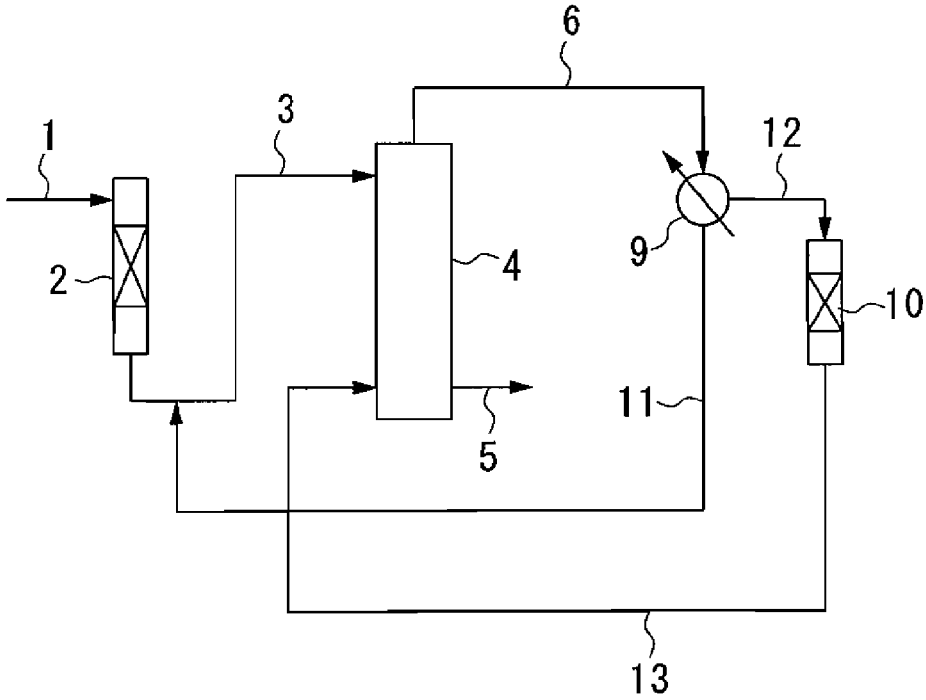
FIG. 3 is a schematic block diagram representing a third example of the mercury removal apparatus of the present invention.

FIG. 3 represents the third example of the mercury removal apparatus of the present invention and corresponds to the fourth, fifth and, seventh aspects of the present invention.

The apparatus of this example further includes a first gas-liquid separation device 9 after the first stripping device 4 and a second adsorption device 10 after the first gas-liquid separation device 9 in addition to the apparatus represented by FIG. 1.

The first gaseous hydrocarbon withdrawn from the first stripping device 4 is fed to the first gas-liquid separation device 9 through the pipe 6. This first gas-liquid separation device 9 can be a cooler or a condenser, which cools the first gaseous hydrocarbon at a temperature of 20 to 70° C., preferably 30 to 60° C. and condenses the hydrocarbon whose boiling point is relatively high in the first gaseous hydrocarbon so as to be liquefied, thereafter withdrawing it as the third liquid hydrocarbon through the pipe 11. At the same time, the first gas-liquid separation device 9 maintains the hydrocarbon whose boiling point is relatively low in the first gaseous hydrocarbon in a gas form, thereafter withdrawing it as the third gaseous hydrocarbon through a pipe 12.

By using this step which cools the gaseous hydrocarbon withdrawn from the first stripping device 4 so as to be separated into gas and liquid, it is preferably possible to adsorptively remove mercury reliably even when the mercury content in the raw hydrocarbon is high or even when a lot of impurities are contained in the raw hydrocarbon.

By this gas-liquid separation, a large amount of the elemental mercury having been contained in the first gaseous hydrocarbon is contained in the third gaseous hydrocarbon, so the amount of the elemental mercury in the third liquid hydrocarbon is low.

The third gaseous hydrocarbon is introduced into the second adsorption device 10 through the pipe 12, in which the elemental mercury therein is adsorptively removed, and the fourth gaseous hydrocarbon whose elemental mercury concentration is low is withdrawn through a pipe 13. In this second adsorption device 10, the same device and adsorption conditions as the aforementioned first adsorption device 7 are used. Herein, the second adsorption 10 can be replaced with a scrubber which adsorptively removes the elemental mercury in the third gaseous hydrocarbon using a sodium sulfide aqueous solution.

Also, the fourth gaseous hydrocarbon withdrawn from the second adsorption 10 hardly contains elemental mercury and is introduced into the first stripping device 4 through the pipe 13 as the first stripping gas.

In addition, the third liquid hydrocarbon is introduced into the pipe 3 through the pipe 11 and mixed with the first liquid hydrocarbon. Then, the mixed stream is introduced into the first stripping device 4 through the pipe 3.

In this example 3, the fourth gaseous hydrocarbon withdrawn from the second adsorption device 10 can be directly depleted outside the system, and the third liquid hydrocarbon withdrawn from the first gas-liquid separation device 9 can be directly depleted outside the system.

The Fourth Example of the Mercury Removal Apparatus of the Present Invention

Figure 4:
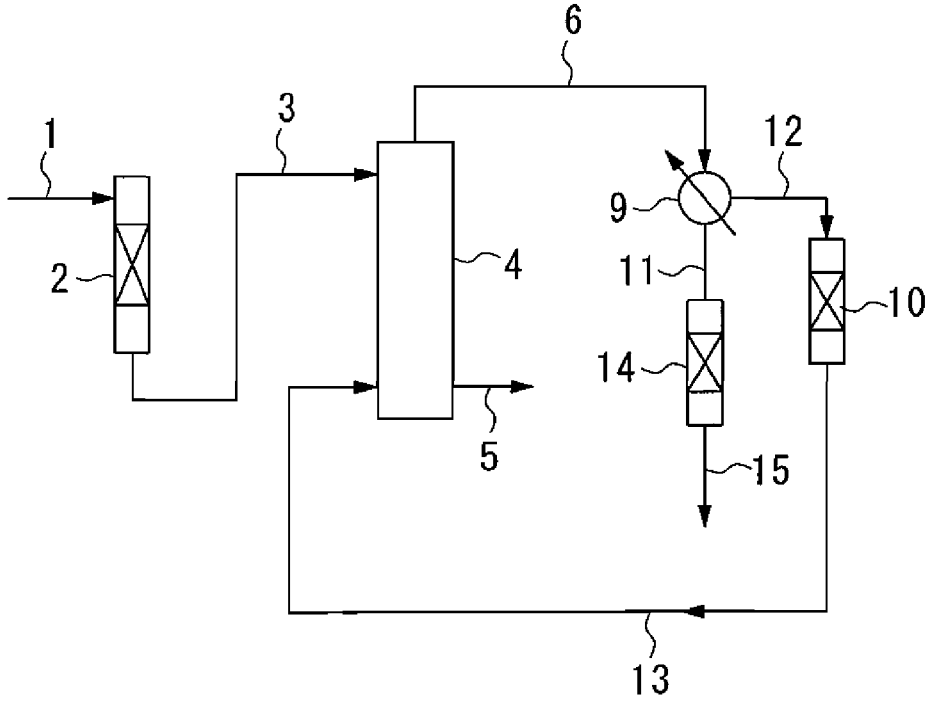
FIG. 4 is a schematic block diagram representing a fourth example of the mercury removal apparatus of the present invention.

FIG. 4 represents the fourth example of the mercury removal apparatus of the present invention and corresponds to the sixth aspect of the present invention.

The apparatus of this example further includes a third adsorption device 14 in addition to the apparatus represented by FIG. 3. In this apparatus, the third liquid hydrocarbon withdrawn from the first gas-liquid separation device 9 through the pipe 11 is introduced into the third adsorption device 14, in which the elemental mercury therein is adsorptively removed, and the fourth liquid hydrocarbon is obtained.

As the third adsorption device 14 for a liquid hydrocarbon, any device can be used as long as it has the capability of adsorptively removing the mercury component in the liquid hydrocarbon. Specifically, the same device as used in the aforementioned first and second adsorption devices 7 and 10 for the gaseous hydrocarbon can be used. In this case, the adsorption conditions are as follows: a slow linear velocity compared with the case of a gaseous hydrocarbon which is specifically 0.1 to 5.0 cm/sec, preferably 0.2 to 3.0 cm/sec. Other adsorption conditions are as follows: a temperature of 0 to 120° C., preferably 0 to 80° C., and a pressure of 0.01 to 2.00 MPa·G, preferably 0.05 to 1.00 MPa·G The fourth liquid hydrocarbon withdrawn from the third adsorption device 14 through a pipe 15 hardly contains elemental mercury, so it is recovered as a product.

The Fifth Example of the Mercury Removal Apparatus of the Present Invention

Figure 5:
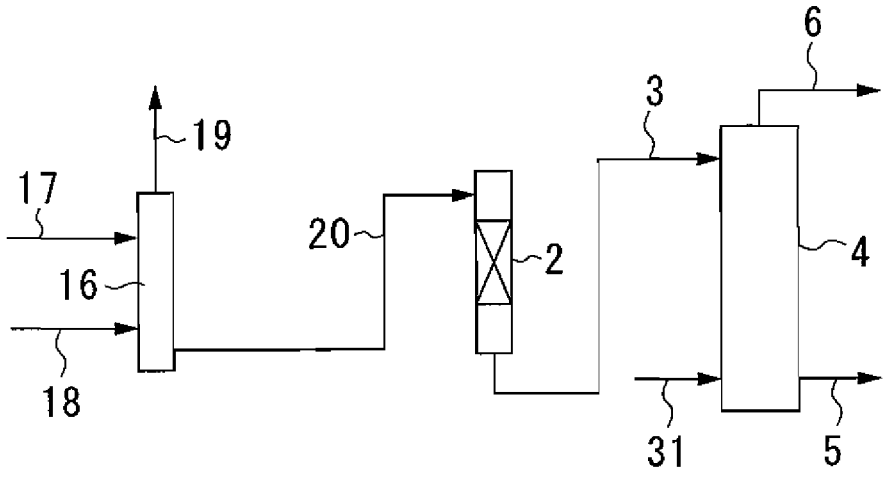
FIG. 5 is a schematic block diagram representing a fifth example of the mercury removal apparatus of the present invention.

FIG. 5 represents the fifth example of the mercury removal apparatus of the present invention and corresponds to the eighth and ninth aspects of the present invention.

The apparatus of this example further includes a second stripping device 16 before the conversion device 2 as a preliminary separation device in addition to the apparatus represented by FIG. 1.

In this apparatus, the raw liquid hydrocarbon is introduced into the second stripping device 16 through a pipe 17, and the second stripping gas is introduced into the second stripping device 16 through a pipe 18 at the same time. As the second stripping device 16, the same packed column as the first stripping device 4 as described above can be used.

The operation conditions of the second stripping device 16 can be the same as those described for the aforementioned first stripping device 4.

In the second stripping device 16, the raw liquid hydrocarbon and the second stripping gas are brought into countercurrent contact, so the elemental mercury in the mercury compound contained in the raw liquid hydrocarbon is transferred to the second stripping gas, and the second stripping gas containing the elemental mercury is withdrawn through a pipe 19 as the fifth gaseous hydrocarbon and depleted outside the system.

Also, the raw liquid hydrocarbon, in which the amount of the elemental mercury decreases and the mercury compound composes a large portion of the mercury component, is withdrawn through a pipe 20 as the fifth liquid hydrocarbon. This fifth liquid hydrocarbon is introduced into the conversion device 2, and the mercury compound therein is converted into elemental mercury.

In this example, the second stripping device 16 is used as the preliminary separation device, while a distillation device such as a distillation column can be used as another preliminary separation device, whereby the elemental mercury is preliminarily separated from the raw liquid hydrocarbon and transferred to the fifth gaseous hydrocarbon.

The Sixth Example of the Mercury Removal Apparatus of the Present Invention

Figure 6:
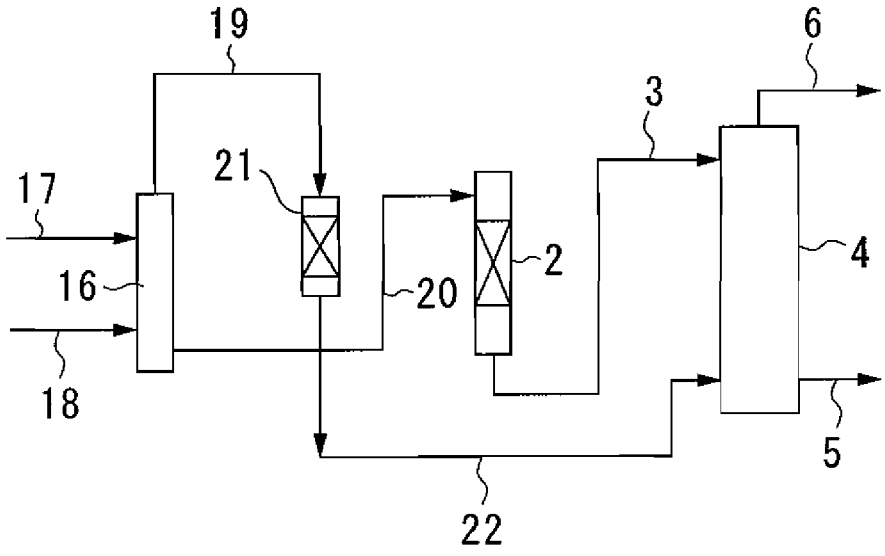
FIG. 6 is a schematic block diagram representing a sixth example of the mercury removal apparatus of the present invention.

FIG. 6 represents the sixth example of the mercury removal apparatus of the present invention and corresponds to the tenth and eleventh aspects of the present invention.

The apparatus of this example further includes a fourth adsorption device 21 after the second stripping device 16 in addition to the apparatus represented by FIG. 5. In this apparatus, the fifth gaseous hydrocarbon withdrawn from the second stripping device 16, in which the amount of the elemental mercury is high, is introduced into the fourth adsorption device 21 through the pipe 19, in which the elemental mercury therein is adsorptively removed, and the sixth gaseous hydrocarbon in which the amount of the elemental mercury is low is withdrawn through a pipe 22. In addition, this sixth gaseous hydrocarbon is recycled as the first stripping gas for the first stripping device 4.

As the fourth adsorption device 21, the same adsorption column as used in the aforementioned first, second, and third adsorption devices 7, 10, and 14 can be used, and the same adsorption conditions as for the first adsorption device 7 can be used.

The sixth gaseous hydrocarbon withdrawn from the fourth adsorption device 21 hardly contains elemental mercury, so it is effectively used as the first stripping gas.

Herein, it is possible for the sixth gaseous hydrocarbon to not be used as the sixth hydrocarbon but be directly depleted outside the system.

Figure 7:
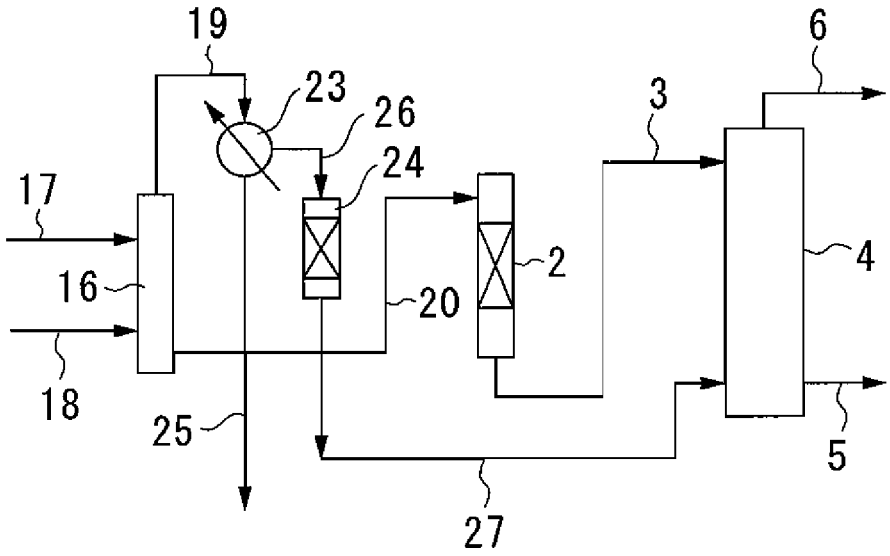
FIG. 7 is a schematic block diagram representing a seventh example of the mercury removal apparatus of the present invention.

The Seventh Example of the Mercury Removal Apparatus of the Present Invention FIG. 7 represents the seventh example of the mercury removal apparatus of the present invention and corresponds to the twelfth and thirteenth aspects of the present invention.

The apparatus of this example further includes a second gas-liquid separation device 23 after the second stripping device 16 and a fifth adsorption device 24 after this second gas-liquid separation device 23 in addition to the apparatus represented by FIG. 6.

The second gas-liquid separation device 23 can be a cooler specifically. Into this second gas-liquid separation device 23, the fifth gaseous hydrocarbon is introduced and then cooled at the temperature of 40 to 60° C., and the hydrocarbon whose boiling point is relatively high in the fifth gaseous hydrocarbon is condensed so as to be liquefied, and then directly withdrawn as the seventh liquid hydrocarbon through a pipe 25. Also, the hydrocarbon whose boiling point is low in the fifth gaseous hydrocarbon is withdrawn from the second gas-liquid separation device 23 through a pipe 26 as the seventh gaseous hydrocarbon. Due to this gas-liquid separation, a part of the elemental mercury contained in the fifth gaseous hydrocarbon is transferred to the sixth liquid hydrocarbon, while the residue is transferred to the seventh gaseous hydrocarbon.

This seventh gaseous hydrocarbon is introduced into the fifth adsorption device 24 through the pipe 26. The fifth adsorption device 24 can be the aforementioned adsorption column which is filled with the same adsorbent as described above, in which the elemental mercury in the seventh gaseous hydrocarbon is adsorptively removed, and the eighth gaseous hydrocarbon in which the amount of the elemental mercury decreases is obtained. The adsorption conditions in the fifth adsorption device 24 can be the same as those for the first adsorption device 7.

The eighth gaseous hydrocarbon obtained by the fifth adsorption device 24 can be directly depleted outside the system, or as represented by the figure, the eighth gaseous hydrocarbon can be introduced into the first stripping device 4 through a pipe 27 and used as the first stripping gas.

Figure 8:
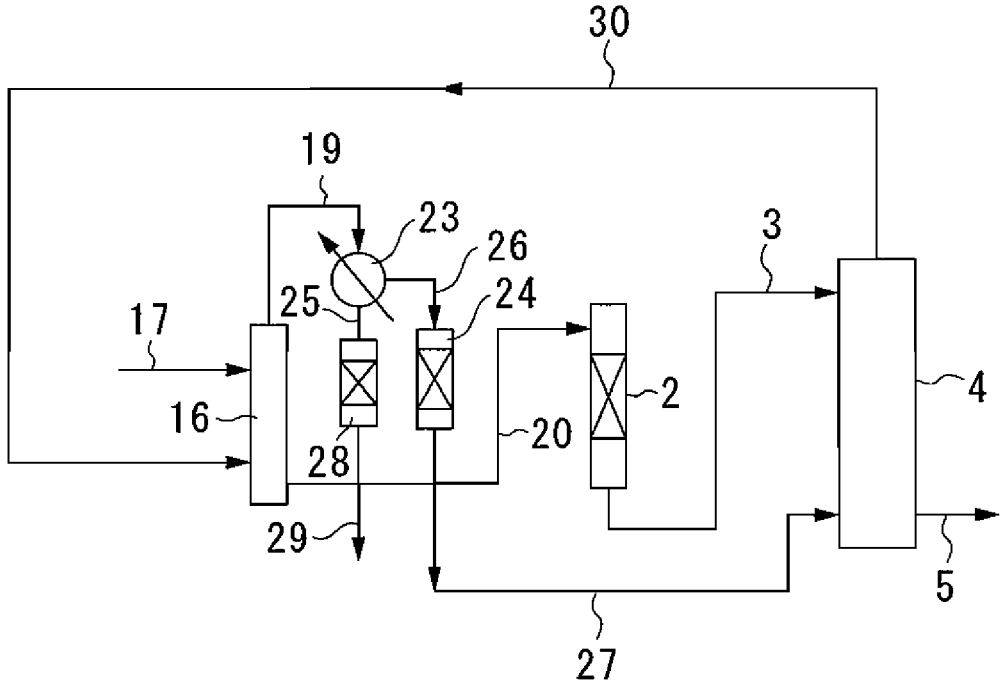
FIG. 8 is a schematic block diagram representing an eighth example of the mercury removal apparatus of the present invention.

The Eighth Example of the Mercury Removal Apparatus of the Present Invention FIG. 8 represents the eighth example of the mercury removal apparatus of the present invention and corresponds to the fourteenth and fifteenth aspects of the present invention.

The apparatus of this example further includes a sixth adsorption device 28 in addition to the apparatus represented by FIG. 7. In this apparatus, the sixth liquid hydrocarbon is introduced from the second gas-liquid separation device 23 through the pipe 25 into the sixth adsorption device 28, in which the amount of the elemental mercury therein is reduced, and the seventh liquid hydrocarbon is withdrawn through a pipe 29 as a product. As the sixth adsorption device 28, the same adsorption column as used in the aforementioned adsorption device can be used, and the same adsorption condition as for the third adsorption device 14 can be used.

Also, in this example, the first gaseous hydrocarbon withdrawn from the first stripping device 4 is introduced into the second stripping device 16 through a pipe 30 as the second stripping gas. However, the first gaseous hydrocarbon is not necessarily referred to as the second stripping gas, but can be directly used as a fuel gas or depleted outside the system after removing the elemental mercury therein by an adsorption process if necessary.

The Ninth Example of the Mercury Removal Apparatus of the Present Invention

Figure 9:
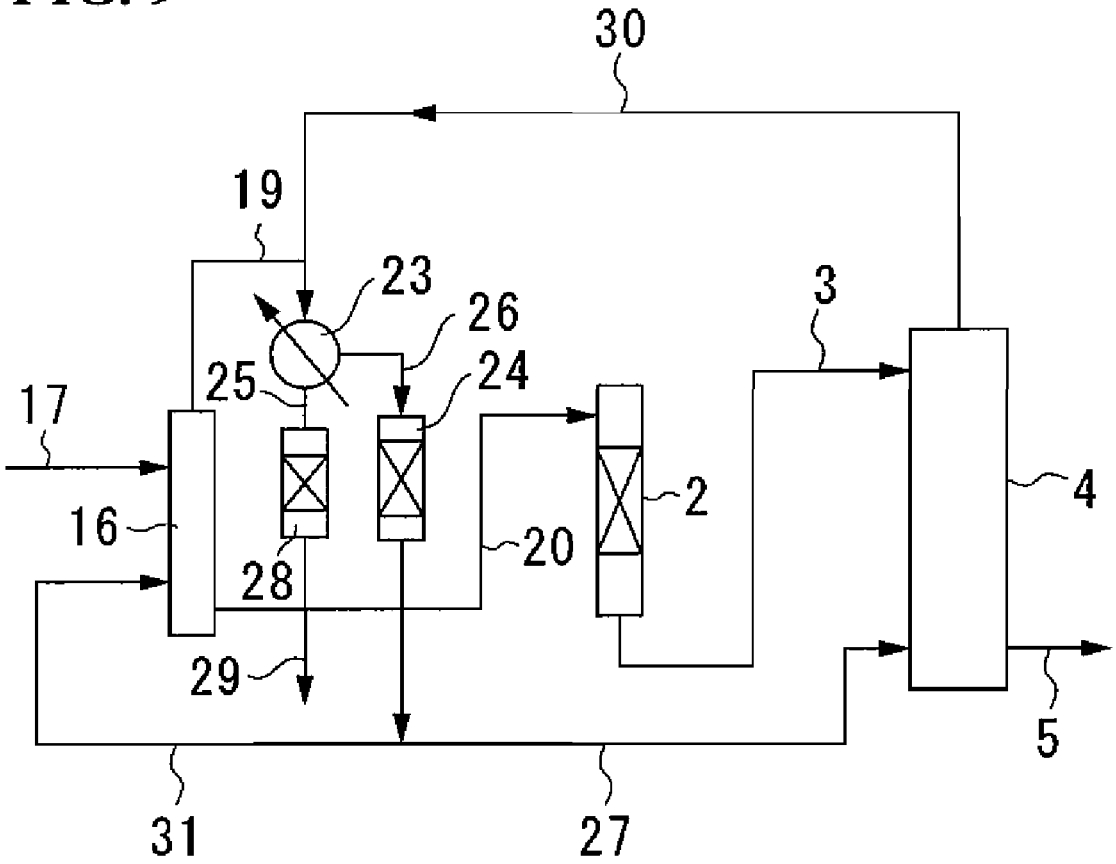
FIG. 9 is a schematic block diagram representing a ninth example of the mercury removal apparatus of the present invention.

FIG. 9 represents the ninth example of the mercury removal apparatus of the present invention. The apparatus of this example, in the apparatus represented by FIG. 8, divides the eighth gaseous hydrocarbon, which hardly contains a mercury component and is withdrawn from the fifth adsorption device 24, in two, one of which is introduced into the first stripping device 4 through the pipe 27 and used as the first stripping gas, and the other of which is introduced into the second stripping device 16 through the pipe 31 and used as the second stripping gas.

Also, the first gaseous hydrocarbon withdrawn from the first stripping device 4 is introduced into the second gas-liquid separation device 23 through the pipe 30 and separated into gas and liquid with the fifth gaseous hydrocarbon introduced from the stripping device 16 through the pipe 19.

In this apparatus, the raw liquid hydrocarbon is stripped by the eighth gaseous hydrocarbon hardly containing mercury component, so the elemental mercury concentration greatly decreases in the fifth liquid hydrocarbon withdrawn from the second stripping device 16. Therefore, the risk decreases in that elemental mercury is converted into ionic mercury in the conversion device 2.

EXAMPLES

Hereinafter, specific examples are described.

Example 1

By using the apparatus represented by FIG. 3, the mercury component in a natural gas condensate (Erawan-condensate) which becomes the raw liquid hydrocarbon was removed.

In the natural gas condensate, the elemental mercury and the ionic mercury were contained at 520 wtppb and 140 wtppb, respectively.

As the conversion device 2, a reaction column formed of a stainless steel pipe (JIS Standard: SUS304) with a pipe diameter of 1 inch was used, and as the catalyst, MR-14 produced by JGC Corporation was used. The reaction conditions were as follows: a temperature of 200° C., a pressure of 0.6 MPa·G, and a retention time of the raw liquid hydrocarbon of 25 min.

As the first stripping device 4, a packed column was used. This packed column includes a column with a diameter of 1 inch and a length of 250 mm, which was filled with a Goodloe (registered trademark) packing as a filler to reach a filling height of 200 mm. A Goodloe (registered trademark) packing is a type of filler referred to as Mesh Demister.

The stripping conditions were as follows: a temperature of 100° C., a pressure of 0.05 MPa·G, a feed rate of the first liquid hydrocarbon of 5,900 kg/m$^2$·hr, a feed rate of the first stripping gas of 1,800 kg/m$^2$·hr, and a gas/liquid flow ratio of 0.31 kg-G/kg-L.

As the first stripping gas, the fourth gaseous hydrocarbon from the second adsorption device 10 was used.

As the first gas-liquid separation device 9, a commercially available condenser was used, and the cooling temperature of the first gaseous hydrocarbon was 40° C.

Also, as the second adsorption device 10, an adsorption column was used. This adsorption column includes a column made of a stainless steel (JIS Standard: SUS304), which was filled with MR-3 produced by JGC Corporation as an adsorbent to reach a filling height of 250 mm.

The adsorption conditions of the second adsorption device 10 were as follows: a temperature of 40° C., a pressure of 0.02 MPa·G, and a gas linear velocity of 0.2 m/sec.

By using the operation conditions as described above, the aforementioned natural gas condensate was fed to the conversion device 2; consequently, the mercury component concentration in the second liquid hydrocarbon withdrawn from the first stripping device 4 became 2.1 wtppb. This second liquid hydrocarbon was able to be used as a product.

Comparative Example

In Example 1, the natural gas condensate which is the raw liquid hydrocarbon was fed not to the conversion device 2 but to the first stripping device 4 directly; consequently, the mercury component concentration in the second liquid hydrocarbon withdrawn from the first stripping device 4 became 147 wtppb.

Example 2

By using the apparatus represented by FIG. 4, the mercury in the raw liquid hydrocarbon was removed.

As a raw liquid hydrocarbon, the natural gas condensate used in Example 1 was used.

Also, as the conversion device 2, the first stripping device 4, the first gas-liquid separation device 9, and the second adsorption device 10, the same as those used in Example 1 were used, and each operation condition thereof was the same.

As the third adsorption device 14, an adsorption column was used. This adsorption column includes a column formed of a stainless steel pipe (JIS Standard: SUS304) with an inside diameter of 20 mm and a length of 400 mm, which was filled with MR-3 produced by JGC Corporation as an adsorbent to reach a filling height of 250 mm.

The adsorption conditions of the third adsorption device 14 were as follows: a temperature of 40° C., a pressure of 0.5 MPa·G, and a liquid linear velocity of 0.5 cm/sec.

As a result, the second liquid hydrocarbon from the first stripping device 4 and the fourth liquid hydrocarbon from the third adsorption device 14 were able to be withdrawn as products, and the mercury component concentration in the mixture thereof was 1.6 wtppb.

Example 3

By using the apparatus represented by FIG. 8, the mercury in the raw liquid hydrocarbon was removed.

As a raw liquid hydrocarbon, a natural gas condensate was used, in which the elemental mercury content was 2,140 wtppb and the ionic mercury content was 300 wtppb.

As the second stripping device 16 and the first stripping device 4, a packed column was used.

This packed column includes a column with a diameter of 1 inch and a length of 250 mm, which was filled with a Goodloe (registered trademark) packing as a filler to reach a filling height of 200 mm.

The stripping conditions were as follows: a temperature of 100° C., a pressure of 0.05 MPa·G, a feed rate of the first liquid hydrocarbon of 2,000 kg/m$^2$·hr, a feed rate of the first stripping gas of 3,660 kg/m$^2$·hr, a gas/liquid flow ratio in the first stripping device 4 of 1.83 kg-G/kg-L, a feed rate of the raw liquid hydrocarbon of 2,100 kg/m$^2$·hr, a feed rate of the second stripping gas of 3,900 kg/m$^2$·hr, and a gas/liquid flow ratio in the second stripping device 16 of 1.86 kg-G/kg-L.

As the conversion device 2, a reaction column formed of the stainless steel pipe (JIS Standard: SUS304) with a pipe diameter of 1 inch was used, and as the catalyst, 20 ml of MR-14 produced by JGC Corporation was used. The reaction conditions were as follows: a temperature of 200° C., a pressure of 0.6 MPa·G, and a retention time of the fifth liquid hydrocarbon of 25 min.

As the fifth adsorption device 24, an adsorption column was used. This adsorption column includes a column made of a stainless steel (JIS Standard: SUS304), with an inside diameter of 20 mm and a length of 400 mm, which was filled with MR-3 produced by JGC Corporation as an adsorbent to reach a filling height of 250 mm. The adsorption conditions of the fifth adsorption device 24 were as follows: a temperature of 20° C., a pressure of 0.01 MPa·G, and a gas linear velocity of 0.2 m/sec.

As the sixth adsorption device 28, an adsorption column was used. This adsorption column includes a column made of a stainless steel (JIS Standard: SUS304), with a inside diameter of 20 mm and a length of 400 mm, which was filled with MR-3 produced by JGC Corporation as an adsorbent to reach a filling height of 250 mm.

The adsorption conditions of the sixth adsorption device 28 were as follows: a temperature of 30° C., a pressure of 0.01 MPa·G, and a liquid linear velocity of 0.5 cm/sec.

As the second gas-liquid device 23, a condenser was used, and the operation conditions were as follows: a cooling temperature of 30° C. and a flowing gas temperature of 100° C.

As a result, the amount of the elemental mercury and the amount of the ionic mercury in the fifth liquid hydrocarbon were 174 wtppb and 314 wtppb, respectively. Also, the amount of the elemental mercury and the amount of the ionic mercury in the first liquid hydrocarbon were 404 wtppb and 1.6 wtppb, respectively. In addition, the amount of the elemental mercury and the amount of the ionic mercury in the mixture of the second liquid hydrocarbon and the seventh liquid hydrocarbon, which becomes a final product, were 0.6 wtppb and 1.7 wtppb, respectively.

INDUSTRIAL APPLICABILITY

According to the mercury removal apparatus of the present invention, a device which removes the mercury component contained in a liquid hydrocarbon such as crude oil or natural gas condensate can be provided inexpensively, so the present invention is useful industrially.

The invention claimed is:

1. A mercury removal apparatus for a liquid hydrocarbon, comprising:

a conversion device which converts a mercury component in a raw liquid hydrocarbon into elemental mercury to obtain a first liquid hydrocarbon containing the elemental mercury; and a first stripping device which brings the first liquid hydrocarbon into counter-current contact with a first stripping gas, thereby transferring the elemental mercury in the first liquid hydrocarbon to the first stripping gas to obtain a second liquid hydrocarbon in which the amount of the elemental mercury decreases and a first gaseous hydrocarbon containing the elemental mercury.

2. A mercury removal apparatus for a liquid hydrocarbon according to claim 1, further comprising a first adsorption device which adsorptively removes the elemental mercury from the first gaseous hydrocarbon to obtain a second gaseous hydrocarbon.

3. A mercury removal apparatus for a liquid hydrocarbon according to claim 2, wherein the second gaseous hydrocarbon is used as the first stripping gas.

4. A mercury removal apparatus for a liquid hydrocarbon according to claim 1, further comprising:

a first gas-liquid separation device which cools the first gaseous hydrocarbon so as to be separated into a third gaseous hydrocarbon and a third liquid hydrocarbon; and a second adsorption device which adsorptively removes the elemental mercury from the third gaseous hydrocarbon to obtain a fourth gaseous hydrocarbon.

5. A mercury removal apparatus for a liquid hydrocarbon according to claim 4, wherein the fourth gaseous hydrocarbon is used as the first stripping gas.

6. A mercury removal apparatus for a liquid hydrocarbon according to claim 4, further comprising a third adsorption device which adsorptively removes the elemental mercury from the third liquid hydrocarbon to obtain a fourth liquid hydrocarbon.

7. A mercury removal apparatus for a liquid hydrocarbon according to claim 4, wherein the third liquid hydrocarbon is introduced into the first stripping device with the first liquid hydrocarbon.

8. A mercury removal apparatus for a liquid hydrocarbon according to claim 1, further comprising:

a preliminary separation device provided before the conversion device, which separates the raw liquid hydrocarbon into a fifth gaseous hydrocarbon whose mercury component is in high concentration and a fifth liquid hydrocarbon whose mercury component is in low concentration, wherein the fifth liquid hydrocarbon is introduced into the conversion device.

9. A mercury removal apparatus for a liquid hydrocarbon according to claim 8, wherein the preliminary separation device is a second stripping device which brings the raw liquid hydrocarbon into counter-current contact with a second stripping gas so as to be separated into the fifth gaseous hydrocarbon and the fifth liquid hydrocarbon.

10. A mercury removal apparatus for a liquid hydrocarbon according to claim 8, further comprising a fourth adsorption device which adsorptively removes the mercury component from the fifth gaseous hydrocarbon to obtain a sixth gaseous hydrocarbon.

11. A mercury removal apparatus for a liquid hydrocarbon according to claim 10, wherein the sixth gaseous hydrocarbon is used as the first stripping gas.

12. A mercury removal apparatus for a liquid hydrocarbon according to claim 8, further comprising:

a second gas-liquid separation device which cools the fifth gaseous hydrocarbon to separate a seventh gaseous hydrocarbon and a sixth liquid hydrocarbon; and a fifth adsorption device which adsorptively removes the mercury component from the seventh gaseous hydrocarbon to obtain an eighth gaseous hydrocarbon.

13. A mercury removal apparatus for a liquid hydrocarbon according to claim 12, wherein the eighth gaseous hydrocarbon is used as the first stripping gas.

14. A mercury removal apparatus for a liquid hydrocarbon according to claim 12, further comprising a sixth adsorption device which adsorptively removes the mercury component from the sixth liquid hydrocarbon to obtain a seventh liquid hydrocarbon.

15. A mercury removal apparatus for a liquid hydrocarbon according to claim 9, wherein the first gaseous hydrocarbon is used as the second stripping gas.

* * * * *